United States Patent [19]

Gies

[11] 4,119,290

[45] Oct. 10, 1978

[54] STAND FOR RELEASABLY LOCKING A POLE-LIKE MEMBER IN UPRIGHT POSITION

[76] Inventor: Jakob Gies, Solmser Strasse 14, 6434 Niederaula, Mengshausen, Germany

[21] Appl. No.: 724,419

[22] Filed: Sep. 20, 1976

[51] Int. Cl.[2] ..... A47G 33/12

[52] U.S. Cl. ..... 248/523; 279/56

[58] Field of Search ..... 248/523, 524, 525, 526, 248/528, 529; 279/57, 121, 56; 403/369, 374

[56] References Cited

U.S. PATENT DOCUMENTS

| | | | |
|---|---|---|---|
| 594,587 | 11/1897 | Almond | 279/56 |
| 866,788 | 9/1907 | Holstein | 279/58 |
| 1,293,180 | 2/1919 | Pace | 279/56 X |
| 1,805,095 | 5/1931 | Horni | 403/374 X |
| 2,245,316 | 6/1941 | Amlser | 279/58 X |
| 2,699,589 | 1/1955 | Redell | 279/56 X |
| 3,217,519 | 11/1965 | Demler | 279/57 X |
| 3,400,905 | 9/1968 | Van Dusen, Jr. | 403/369 X |
| 3,885,763 | 5/1975 | Blom | 248/529 X |

FOREIGN PATENT DOCUMENTS

| | | | |
|---|---|---|---|
| 200,214 | 7/1908 | Fed. Rep. of Germany | 248/523 |
| 236,066 | 7/1925 | United Kingdom | 248/523 |

*Primary Examiner*—Roy D. Frazier
*Assistant Examiner*—Peter A. Aschenbrenner
*Attorney, Agent, or Firm*—Hane, Roberts, Spiecens & Cohen

[57] ABSTRACT

There is disclosed a stand for releasably locking a pole-like member in upright position, especially for setting up a Christmas tree. The stand has a tubular holder in which are provided several equally plate-shaped clamping members. These clamping members can be simultaneously radially inwardly moved and also outwardly displaced, thereby adapting the stand for receiving tree trunks of different diameters and clamping the trunks by displacing the clamping members radially inwardly. Setting of the clamping members is effected by a setting device, operation of which acts simultaneously upon all the clamping members.

8 Claims, 3 Drawing Figures

STAND FOR RELEASABLY LOCKING A POLE-LIKE MEMBER IN UPRIGHT POSITION

The invention relates to a stand for locking a pole-shaped member in upright position and, more particularly, for setting up a tree trunk such as the trunk of a Christmas tree.

BACKGROUND OF THE INVENTION

Stands of the general type above-referred to, especially for setting up Christmas trees, are known. The stands as now known consist essentially of a tubular holder which has several spread apart legs for holding the stand itself in a substantially upright position. Locking of a tree trunk or other pole-shaped member inserted into the holder is effected by screw bolts which serve as clamping members and must be one-by-one inwardly and outwardly turned. The inner screw ends are generally somewhat pointed so that they penetrate into the trunk.

The problem with these known stands is that the holder screws, usually three screws, must be carefully adjusted relative to each other for securing the tree or other pole-shaped member in a substantially perfect upright position.

THE INVENTION

It is a broad object of the invention to provide a novel and improved stand of the general kind above-referred to which greatly simplifies the locking of the trunk of a tree or other pole-shaped member in an accurately upright position and which can also be readily adapted to different diameters of the trunk to be set up.

A more specific object of the invention is to provide a novel and improved stand of the general type above-referred to in which several generally plate-shaped clamping members can be simultaneously pressed against the trunk, thereby automatically locking the trunk in upright position.

Another more specific object of the invention is to provide a tubular holder in which several clamping members are placed so that the inside surfaces of these members define the area available for inserting a trunk to be locked in upright position and in which the holder further includes a setting device for simultaneously moving the clamping member readily inwardly for adjusting the available area to the diameter of the trunk to be set up and for pressing the clamping members against the trunk.

Still another object of the invention is to provide in a stand of the general type above-referred to setting means which include setting members that can be operated for axially upward or downward movements and which, as a result of such movements, either press the clamping members against the tree trunk or withdraw the same therefrom.

The invention further provides that the setting members can be screwed upwardly or downwardly in the holder and are so shaped that slanted surfaces on the setting members coact with complementary slanted surfaces on the clamping members, said co-action resulting in radially inward or radially outward movement of the clamping members, depending upon whether the setting members are moved axially upward or downward. To assure movement of the clamping member in the desired radial directions, coacting guide tracks and flanges are provided on the clamping members and in the holder or the setting means.

The invention also provides that the holder has a broadened base so that it will safely rest on the floor or other support without requiring special legs.

As a result of the afore-described structure of a stand according to the invention, locking of a pole member such as the trunk of a Christmas tree in upright position can be effected by simple rotation of the setting means without the heretofore required careful balancing of the turning of pointed locking screws relative to each other. Similarly, release of the tree trunk from the stand is equally simple as all that is necessary is to turn the setting members in the direction permitting radially outward movement of the clamping members.

BRIEF DESCRIPTION OF THE DRAWING

In the accompanying drawing a preferred embodiment of the invention is shown by way of illustration and not by way of limitation.

In the Drawing

DETAILED DESCRIPTION OF THE DRAWING

Figure 3:
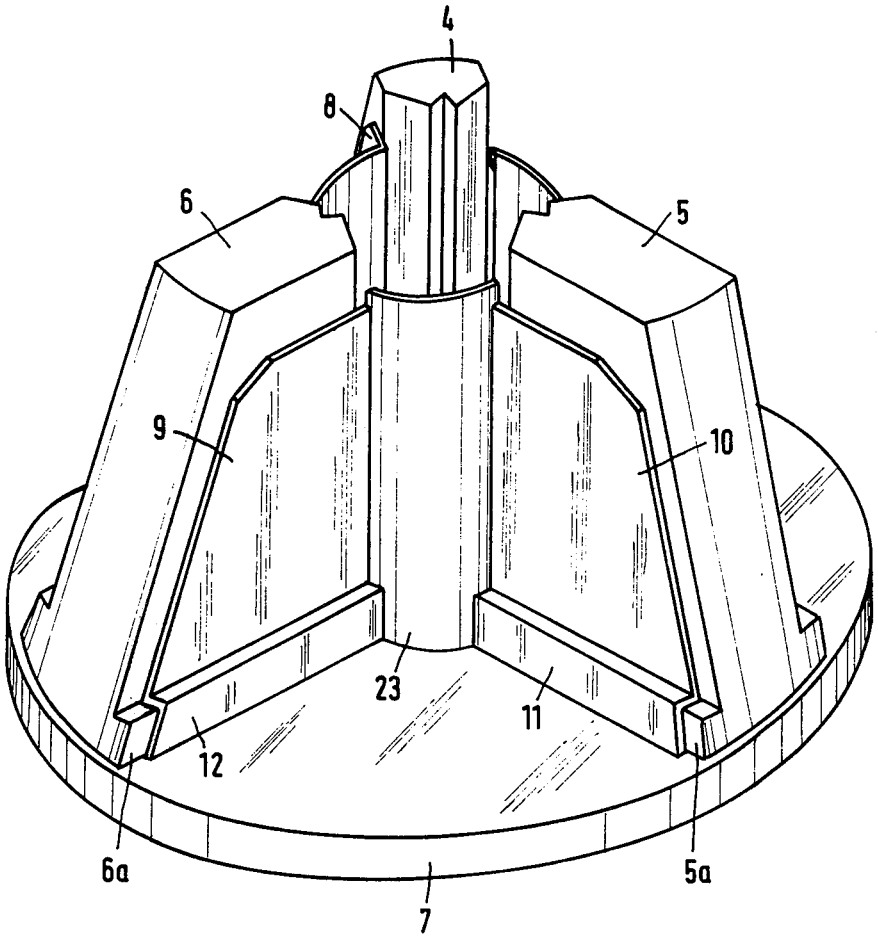
FIG. 3 is a perspective view of the stand but without the setting means.

Referring now to the drawing figures in greater detail, the stand comprises a tubular or sleeve-shaped holder 1 which terminates at its lower end in peripheral extension 2, thereby increasing the stability of the stand when placed on a base. The holder has preferably a double wall as is shown, the inner one of these walls being formed with a threading 3. Several clamping members are disposed within the holder on a plate 7. Three clamping members 4, 5 and 6 are shown which can be radially displaced on the plate. To guide the clamping members guide tracks 8*a*, 9*a* and 10*a* are provided which are formed on plate 7 by ribs 8, 9 and 10 protruding from the plate either integral therewith or fixedly secured thereto, as it is best shown in FIG. 3. The ribs 9 and 10, 8 and 9 and 8 and 10 may be joined by curved apron portions 23. Crosswise to the axial direction of the holder the aforementioned guide tracks are provided with flanges 11, 12 and 13 so that the guides are obtained in which corresponding flanges 4*a*, 5*a* and 6*a* of the clamping members 4, 5 and 6 are guide(See FIG. 3). This has the advantage that the clamping members cannot fall out of the holder if the stand is titled or even turned upside down.

Figure 1:
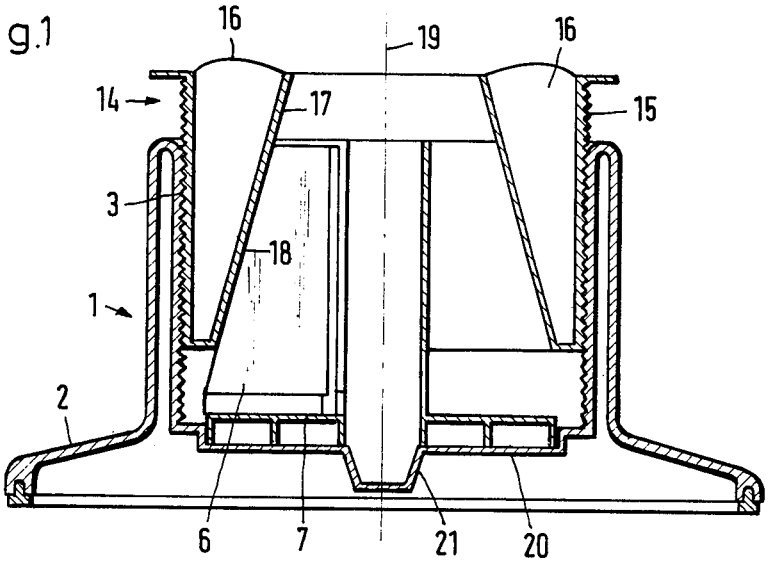
FIG. 1 is an elevational sectional view of a stand according to the invention.
Figure 2:
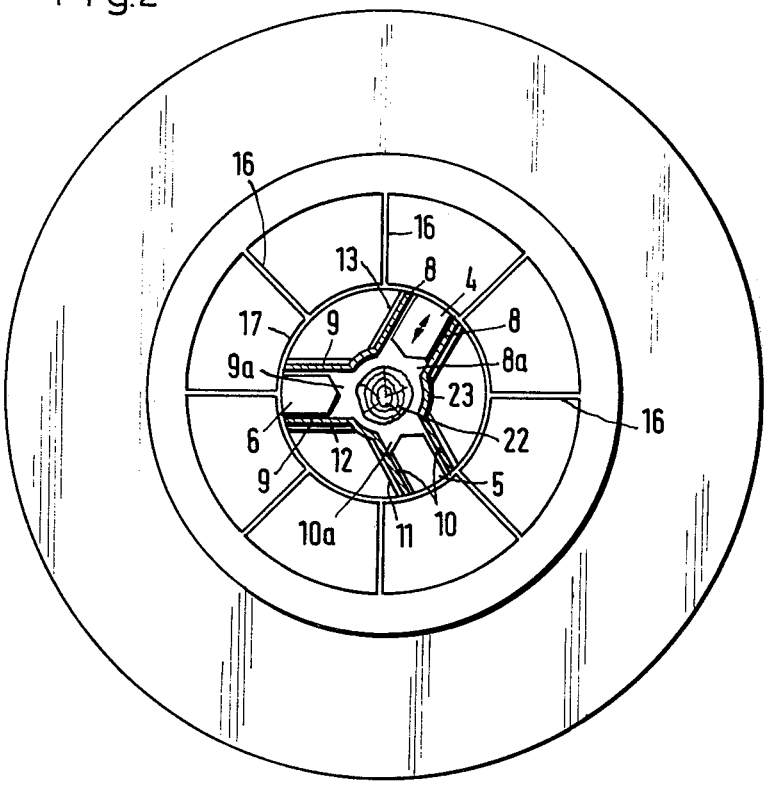
FIG. 2 is a top view of FIG. 1.

The setting means generally designated by 14 are disposed between the inner wall of holder 1 and the clamping members 4, 5 and 6. The setting means comprise a device which is axially displaceable relative to the holder and the clamping members. This device comprises a cylindrical sleeve 15, the outside of which is in threaded engagement with the threading 3 on the inside wall of the holder. This cylinder supports by means of struts 16 the conical members 17. As it is clearly shown in FIG. 1, this conical member coacts on its radially inner surface with a complementary slanted surface 18 on the outer radial surface of each of the clamping members. However, in some instances, the slanted surface on the conical member 17 is replaced by straight or otherwise shaped surfaces which assure radially inward movement of the clamping member when member 17 is moved downwardly.

As it is now apparent, rotation of the cylinder 15 relative to the stationary holder 1 will move the entire setting means axially upwardly or downwardly depending upon the direction of rotation of the cylinder. As it is evident, upward movement will be coaxial with the center axis 19 of the stand and move the clamping members 4, 5 and 6 radially inwardly. Position in which the end of a tree trunk or other pole-shaped member to be locked in upright position can be inserted into the stand. In FIG. 3, there is schematically indicated a section of a tree trunk by reference numeral 22.

The holder 1 is preferably closed at its lower end by a base plate 20 which has in its center a depression 21 which may be used as a basin for water.

As previously indicated, the stand according to the invention is useful not only for setting up Christmas trees or other pole-shaped members, but can also be used if properly reinforced to support heavy items, such as, for instance, a patio umbrella, in upright position.

While the invention has been described in detail with respect to a certain now preferred example and embodiment of the invention, it will be understood by those skilled in the art, after understanding the invention, that various changes and modifications may be made without departing from the spirit and scope of the invention, and it is intended, therefore, to cover all such changes and modifications in the appended claims.

What is claimed is:

1. A stand for releasably locking pole-like members of different diameters in an upright position, said stand comprising:

a tubular holder for mounting a pole-shaped member; circumferentially spaced clamping members mounted on said holder radially displaceable therein, the radially inner surfaces of the clamping members defining the peripheral outline of the space available for receiving the pole-shaped member; and setting means for selectively increasing and reducing the peripheral outline of said area, said setting means including an axially displaceable setting member disposed between the inner wall of the holder and the radially outer surfaces of the clamping members and coacting with said inner wall and outer surfaces so as to apply radially inwardly directed pressure upon said clamping members in response to an axially downward movement and to release the pressure in response to an axially upward movement, and a bottom plate on said holder, said bottom plate including for each of said clamping members a radially extending guide track, each of said clamping members being slidably guided in the respective one of said tracks.

2. The stand according to claim 1 wherein radially disposed ribs are secured to said bottom plate upwardly protruding therefrom, said ribs defining said guide tracks.

3. The stand according to claim 1 wherein said clamping members and said guide tracks comprise flanges and shoulders coacting so as to retain the clamping members in the holder if the latter is tilted sideways or downwards.

4. A stand for releasably locking pole-like members of different diameters in an upright position, said stand comprising:

a tubular holder for mounting a pole-shaped member; circumferentially spaced clamping members mounted on said holder radially displaceable therein, the radially inner surfaces of the clamping members defining the peripheral outline of the space available for receiving the pole-shaped member; and setting means for selectively increasing and reducing the peripheral outline of said area, said setting means including an axially displaceable setting member disposed between the inner wall of the holder and the radially outer surfaces of the clamping members and coacting with said inner wall and outer surfaces so as to apply radially inwardly directed pressure upon said clamping members in response to an axially downward movement and to release the pressure in response to an axially upward movement; and a bottom plate on said holder, said bottom plate including a depression disposed in axial alignment with the area defined by the radially inner sides of the clamping members, said depression constituting a basin for water.

5. A stand for releasably locking pole-like members of different diameters in an upright position, said stand comprising:

a tubular holder for mounting a pole-shaped member; circumferentially spaced clamping members mounted on said holder radially displaceable therein, the radially inner surfaces of the clamping members defining the peripheral outline of the space available for receiving the pole-shaped member; and setting means for selectively increasing and reducing the peripheral outline of said area, said setting means including an axially displaceable setting member disposed between the inner wall of the holder and the radially outer surfaces of the clamping members and coacting with said inner wall and outer surfaces so as to apply radially inwardly directed pressure upon said clamping members in response to an axially downward movement and to release the pressure in response to an axially upward movement, said holder comprising a bottom plate, pairs of wall plates upwardly extending from said bottom plate, each of said pairs guiding therebetween one of said clamping members, and aprons extending between the facing sides of each two adjacent walls, said aprons in conjunction with said walls constituting an enclosed space for the pole-shaped member to be mounted.

6. A stand according to claim 1 wherein said setting means comprises a sleeve matching the inner peripheral outline of the holder and accommodating said setting member, said sleeve and said setting member being removable from the holder as a unit.

7. The stand according to claim 6 wherein the radially outer surfaces of the clamping members and the coacting inner surface of the setting member are slanted so that downward movement of the sleeve of the setting means causes radial inward movement of the clamping members.

8. The stand according to claim 7 wherein the inside of the holder and the outside surface of said sleeve are in threaded engagement for causing raising or lowering of the sleeve by turning the same relative to the holder.

* * * * *

UNITED STATES PATENT OFFICE

CERTIFICATE OF CORRECTION

PATENT NO. : 4,119,290

DATED : October 10, 1978

INVENTOR(S) : Jakob Gies

It is certified that error appears in the above-identified patent and that said Letters Patent are hereby corrected as shown below:

-- Foreign Application Priority Data

Oct. 22, 1975 Germany..... 25 47 184 --

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*